US011401694B2

(12) United States Patent
Ono

(10) Patent No.: US 11,401,694 B2
(45) Date of Patent: Aug. 2, 2022

(54) METHOD OF CONTROLLING MOTOR GRADER, MOTOR GRADER, AND WORK MANAGEMENT SYSTEM FOR MOTOR GRADER

(71) Applicant: KOMATSU LTD., Tokyo (JP)

(72) Inventor: Yutaka Ono, Tokyo (JP)

(73) Assignee: KOMATSU LTD., Tokyo (JP)

( * ) Notice: Subject to any disclaimer, the term of this patent is extended or adjusted under 35 U.S.C. 154(b) by 699 days.

(21) Appl. No.: 16/082,644

(22) PCT Filed: Mar. 16, 2017

(86) PCT No.: PCT/JP2017/010582
§ 371 (c)(1),
(2) Date: Sep. 6, 2018

(87) PCT Pub. No.: WO2017/164054
PCT Pub. Date: Sep. 28, 2017

(65) Prior Publication Data

US 2020/0299934 A1 Sep. 24, 2020

(30) Foreign Application Priority Data

Mar. 23, 2016 (JP) ..... JP2016-058840

(51) Int. Cl.
*E02F 3/76* (2006.01)
*E02F 9/26* (2006.01)
*E02F 3/84* (2006.01)

(52) U.S. Cl.
CPC ..... *E02F 9/26* (2013.01); *E02F 3/7636* (2013.01); *E02F 3/84* (2013.01)

(58) Field of Classification Search
CPC ..... E02F 3/8152; E02F 3/76; E02F 3/7631; E02F 3/845; E02F 9/2004; E02F 3/842;
(Continued)

(56) References Cited

U.S. PATENT DOCUMENTS 2,748,509 A * 6/1956 Brown ..... B62D 7/14 104/2
2,901,846 A * 9/1959 Armington ..... B60K 17/358 172/830
(Continued)

FOREIGN PATENT DOCUMENTS

CN 104769188 A 7/2015
JP S56-33368 U 4/1981
(Continued)

*Primary Examiner* — Edwin J Toledo-Duran
(74) *Attorney, Agent, or Firm* — Faegre Drinker Biddle & Reath LLP

(57) ABSTRACT

A motor grader includes a vehicular body, a blade, a front wheel located in front of the blade, two rear wheels located in the rear of the blade, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, and a third sensor which detects an angle of swing of the first swing member with respect to the vehicular body as third sensor information. A method of controlling a motor grader includes obtaining the first to third sensor information and calculating positions of the rear wheels based on the obtained first to third sensor information.

14 Claims, 10 Drawing Sheets

(58) Field of Classification Search
CPC . E02F 3/847; E02F 9/262; E02F 3/765; E02F 3/7668; E02F 3/815; E02F 3/84; E02F 3/7636; E02F 3/7663; E02F 3/8157; E02F 3/841; E02F 9/2029; E02F 9/24; E02F 9/26; E02F 9/265; E02F 3/844; E02F 3/7654; E02F 9/2037; B60K 25/04
See application file for complete search history.

(56) References Cited

U.S. PATENT DOCUMENTS

| | | | | |
|---|---|---|---|---|
| 3,299,978 | A * | 1/1967 | Sponsler | B62D 61/12 180/41 |
| 4,470,475 | A * | 9/1984 | Carlson | B62D 53/005 180/242 |
| 5,308,216 | A * | 5/1994 | Herolf | B60P 3/41 180/209 |
| 5,488,472 | A * | 1/1996 | January | G01B 11/2755 356/141.3 |
| 5,951,613 | A | 9/1999 | Sahm et al. | |
| 5,997,013 | A * | 12/1999 | Claxton | B60P 1/045 280/124.112 |
| 6,269,885 | B1 * | 8/2001 | Barber | E02F 3/765 172/7 |
| 6,328,125 | B1 * | 12/2001 | Van Den Brink | B62D 61/08 180/211 |
| 8,032,279 | B2 * | 10/2011 | Rogers | G01C 25/00 701/31.4 |
| 8,393,429 | B2 * | 3/2013 | Thomson | E02F 9/225 180/209 |
| 9,510,522 | B2 * | 12/2016 | Yrjänä | A01G 23/00 |
| 9,637,889 | B2 * | 5/2017 | Elkins | E02F 3/7645 |
| 10,531,607 | B2 * | 1/2020 | Schroeder | A01D 41/141 |
| 11,079,237 | B2 * | 8/2021 | Demiral | G01C 22/02 |
| 11,199,845 | B2 * | 12/2021 | Smith | A01F 25/186 |
| 2002/0007242 | A1 * | 1/2002 | Tanaka | B60K 17/348 701/69 |
| 2006/0124323 | A1 * | 6/2006 | Glover | E02F 9/26 172/2 |
| 2007/0068691 | A1 * | 3/2007 | Smart | E02F 3/764 172/810 |
| 2007/0250236 | A1 | 10/2007 | Newberry et al. | |
| 2008/0084110 | A1 * | 4/2008 | Suzuki | B60T 7/042 701/41 |
| 2008/0091520 | A1 * | 4/2008 | Hatori | G01S 19/14 342/357.24 |
| 2009/0082929 | A1 | 3/2009 | Kendrick | |
| 2009/0206589 | A1 * | 8/2009 | Osswald | B62D 21/14 187/234 |
| 2010/0108336 | A1 * | 5/2010 | Thomson | E02F 9/2207 172/795 |
| 2010/0114430 | A1 * | 5/2010 | Thomson | B62D 11/24 701/41 |
| 2011/0108294 | A1 * | 5/2011 | Thomson | E02F 9/20 172/1 |
| 2011/0301781 | A1 * | 12/2011 | Karlsson | E02F 9/26 701/1 |
| 2013/0035826 | A1 * | 2/2013 | Nakatsu | B62D 5/001 701/41 |
| 2015/0151741 | A1 * | 6/2015 | Taira | G05D 1/0242 701/23 |
| 2015/0197253 | A1 | 7/2015 | Zhu | |
| 2015/0292179 | A1 | 10/2015 | Joergensen et al. | |
| 2017/0200306 | A1 * | 7/2017 | Marsolek | G06T 17/05 |
| 2018/0051445 | A1 * | 2/2018 | Hori | G01G 19/08 |
| 2018/0070531 | A1 * | 3/2018 | Long | A01D 41/127 |
| 2018/0142442 | A1 * | 5/2018 | Tsuji | E02F 9/2271 |
| 2018/0245311 | A1 * | 8/2018 | Shike | G01C 3/06 |
| 2019/0016381 | A1 * | 1/2019 | Simon | B62K 5/10 |
| 2019/0024340 | A1 * | 1/2019 | Ono | E02F 3/76 |
| 2019/0085528 | A1 * | 3/2019 | Ono | B60K 28/16 |
| 2019/0105959 | A1 * | 4/2019 | Knisley | B62D 9/02 |
| 2019/0299725 | A1 * | 10/2019 | Maehara | B60C 23/0416 |
| 2020/0018600 | A1 * | 1/2020 | Korenaga | B62J 45/4151 |
| 2020/0096281 | A1 * | 3/2020 | Chen | F41A 23/34 |
| 2020/0362539 | A1 * | 11/2020 | Plouzek | H04N 7/181 |
| 2021/0220703 | A1 * | 7/2021 | Lee | A63B 24/0087 |
| 2021/0237520 | A1 * | 8/2021 | Ehlert | B60C 23/002 |

FOREIGN PATENT DOCUMENTS

| | | | |
|---|---|---|---|
| JP | H10-141955 | A | 5/1998 |
| JP | 2001-193095 | A | 7/2001 |
| JP | 2010-071018 | A | 4/2010 |

* cited by examiner (A)

(B)

METHOD OF CONTROLLING MOTOR GRADER, MOTOR GRADER, AND WORK MANAGEMENT SYSTEM FOR MOTOR GRADER

TECHNICAL FIELD

The present disclosure relates to a method of controlling a motor grader, a motor grader, and a work management system for a motor grader.

BACKGROUND ART

A motor grader has conventionally been known as a work vehicle. The motor grader is a wheeled work vehicle which grades road surfaces or grounds to a smooth state.

For example, US Patent Application Publication No. 2015/0197253 (PTD 1) discloses a scheme for calculating a geographical coordinate based on information from a plurality of sensors and showing information on current topography on a display.

CITATION LIST

Patent Document

PTD 1: US Patent Application Publication No. 2015/0197253

SUMMARY OF INVENTION

Technical Problem

In order to improve productivity in executing operations in a construction project, current topography to be worked should accurately and efficiently be measured, and execution of an object to be worked should be done based on both of design topography representing a target shape of the object to be worked and the current topography.

An object of the present invention is to provide a method of controlling a motor grader, a motor grader, and a work management system for a motor grader capable of accurately obtaining current topography to be worked.

Solution to Problem

A motor grader according to one disclosure includes a vehicular body, a blade attached to the vehicular body, a front wheel located in front of the blade and attached on each of a left side and a right side of the vehicular body, two rear wheels located in the rear of the blade and arranged in front and rear relation on each of the left side and the right side of the vehicular body, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, and a third sensor which detects an angle of swing of the first swing member with respect to the vehicular body as third sensor information. A method of controlling a motor grader includes obtaining the first to third sensor information detected by the first to third sensors and calculating positions of the rear wheels based on the obtained first to third sensor information.

A motor grader according to one disclosure includes a vehicular body, a blade attached to the vehicular body, a front wheel located in front of the blade and attached on each of a left side and a right side of the vehicular body, two rear wheels located in the rear of the blade and arranged in front and rear relation on each of the left side and the right side of the vehicular body, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, a third sensor which detects an angle of swing of the first swing member with respect to the vehicular body as third sensor information, and a controller connected to the first to third sensors. The controller obtains the first to third sensor information detected by the first to third sensors and calculates positions of the rear wheels based on the obtained first to third sensor information.

A work management system for a motor grader according to one disclosure includes a motor grader and a display. The motor grader includes a vehicular body, a blade attached to the vehicular body, a front wheel located in front of the blade and attached on each of a left side and a right side of the vehicular body, two rear wheels located in the rear of the blade and arranged in front and rear relation on each of the left side and the right side of the vehicular body, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, a third sensor which detects an angle of swing of the first swing member with respect to the vehicular body as third sensor information, a controller connected to the first to third sensors, and a communication apparatus. The controller obtains the first to third sensor information detected by the first to third sensors and calculates positions of the rear wheels based on the obtained first to third sensor information. The communication apparatus transmits data for showing an image based on comparison between the positions of the rear wheels and design topography to the outside. The display shows an image based on the data transmitted from the communication apparatus.

A motor grader according to one disclosure includes a vehicular body including a front frame and a rear frame pivotably coupled to the front frame, a blade attached to the vehicular body, a front wheel located in front of the blade and attached to the vehicular body, a rear wheel located in the rear of the blade and attached to the vehicular body, a position sensor which is attached to the front frame and detects a position of the front frame, an inclination sensor which is attached to the vehicular body and detects an inclination of the vehicular body, and an angle sensor which detects an angle of pivot of the front frame with respect to the rear frame. A method of controlling a motor grader includes obtaining sensor information detected by the position sensor, the inclination sensor, and the angle sensor and calculating a position of the rear wheel based on the obtained sensor information.

A motor grader according to one disclosure includes a vehicular body including a front frame and a rear frame pivotably coupled to the front frame, a blade attached to the vehicular body, a front wheel located in front of the blade and attached to the vehicular body, a rear wheel located in the rear of the blade and attached to the vehicular body, a position sensor which is attached to the front frame and detects a position of the front frame, an inclination sensor which is attached to the vehicular body and detects an inclination of the vehicular body, an angle sensor which detects an angle of pivot of the front frame with respect to the rear frame, and a controller connected to the position sensor, the inclination sensor, and the angle sensor. The controller obtains sensor information detected by the position sensor, the inclination sensor, and the angle sensor and calculates a position of the rear wheel based on the obtained sensor information.

Advantageous Effects of Invention

According to the method of controlling a motor grader and a motor grader in the present invention, accuracy in execution of land-grading works can be improved.

DESCRIPTION OF EMBODIMENTS

Figure 1:
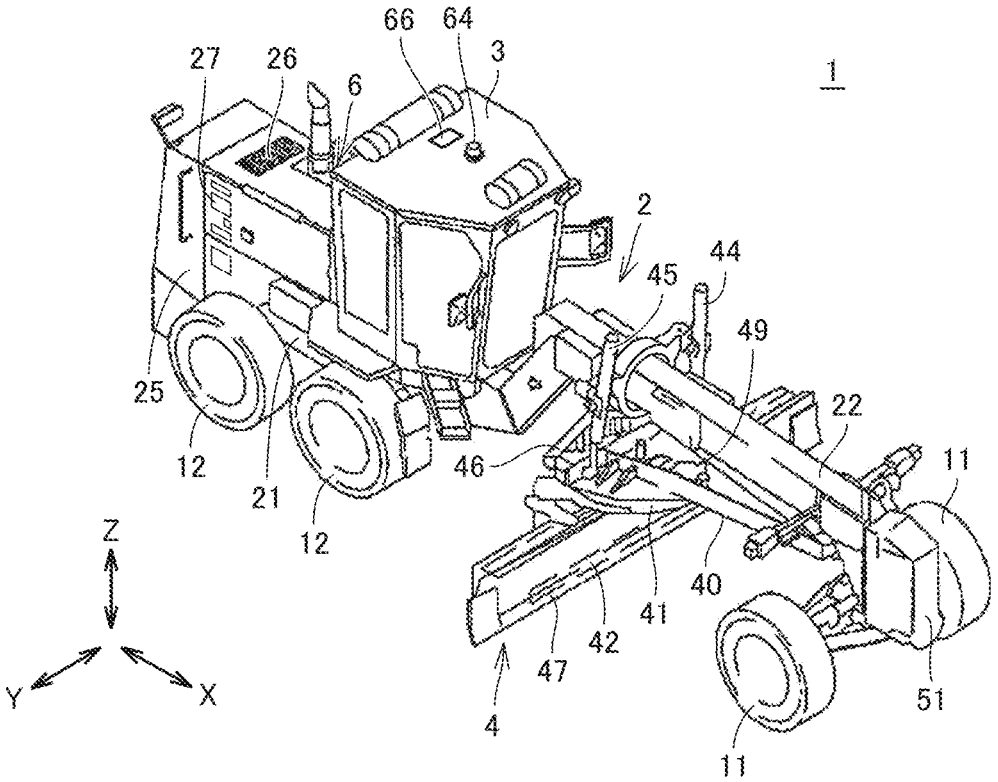
FIG. 1 is a perspective view schematically showing a construction of a motor grader 1 based on an embodiment.

A motor grader according to an embodiment will be described below. The same elements have the same reference characters allotted in the description below and their labels and functions are also the same. Therefore, detailed description thereof will not be repeated.

<A. Appearance>

FIG. 1 is a perspective view schematically showing a construction of a motor grader 1 based on an embodiment.

Figure 2:
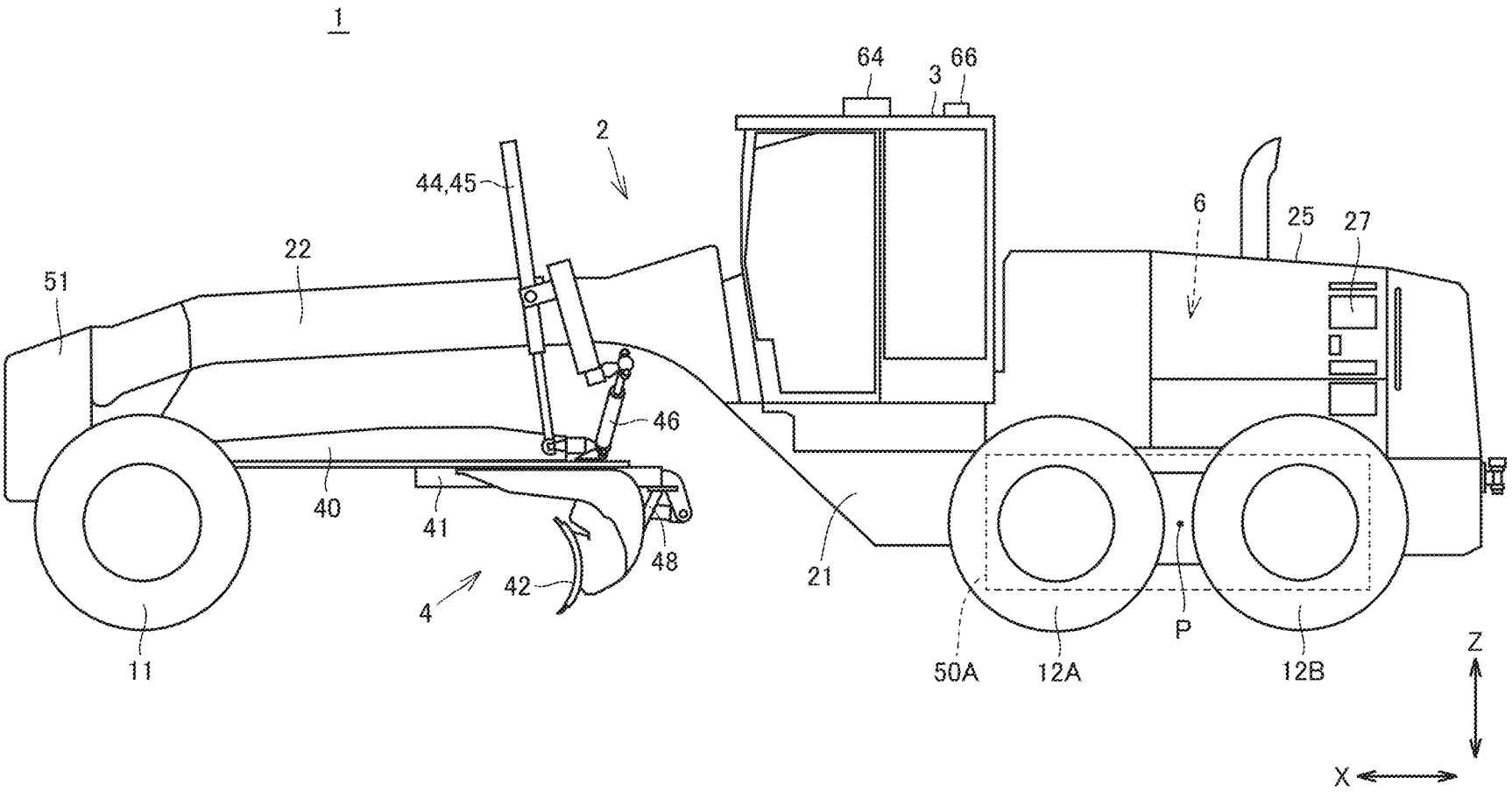
FIG. 2 is a side view schematically showing the construction of motor grader 1 based on the embodiment.

FIG. 2 is a side view schematically showing the construction of motor grader 1 based on the embodiment.

As shown in FIGS. 1 and 2, motor grader 1 in the embodiment mainly includes running wheels 11 and 12, a vehicular body frame 2, a cab 3, and a work implement 4. Motor grader 1 includes components such as an engine arranged in an engine compartment 6. Work implement 4 includes a blade 42. Motor grader 1 can do such works as land-grading works, snow removal works, light cutting, and mixing of materials with blade 42.

Running wheels 11 and 12 include a front wheel 11 and a rear wheel 12. Though FIGS. 1 and 2 show running wheels six in total which consist of two front wheels 11 one on each side and four rear wheels 12 two on each side, the number of front wheels 11 and rear wheels 12 and arrangement thereof are not limited thereto.

Front wheel 11 is located in front of blade 42 and attached on each of a left side and a right side of vehicular body frame 2.

Rear wheels 12 include two wheels located in the rear of blade 42 and arranged in front and rear relation on each of the left side and the right side of vehicular body frame 2. By way of example, FIG. 2 shows a front-side rear wheel 12A and a rear-side rear wheel 12B of left rear wheels 12.

The rear wheels are provided with a tandem apparatus 50A (a first swing member) rotatably supporting both of the two rear wheels arranged in the front and rear relation and swingably supported by vehicular body frame 2. A central point of swing P of tandem apparatus 50A is shown by way of example.

In the description of the drawings below, a direction in which motor grader 1 travels in straight lines is referred to as a fore/aft direction (X) of motor grader 1. In the fore/aft direction of motor grader 1, a side where front wheel 11 is arranged with respect to work implement 4 is defined as the fore direction. In the fore/aft direction of motor grader 1, a side where rear wheel 12 is arranged with respect to work implement 4 is defined as the aft direction. A lateral direction of motor grader 1 is a direction orthogonal to the fore/aft direction in a plan view. A right side and a left side in the lateral direction (Y) in facing front are defined as a right direction and a left direction, respectively. An upward/downward direction (Z) of motor grader 1 is a direction orthogonal to the plane defined by the fore/aft direction and the lateral direction. A side in the upward/downward direction where the ground is located is defined as a lower side and a side where the sky is located is defined as an upper side.

The fore/aft direction refers to a fore/aft direction of an operator who sits at an operator's seat in cab 3. The lateral direction refers to a lateral direction of the operator who sits at the operator's seat. The lateral direction refers to a direction of a vehicle width of motor grader 1. The upward/downward direction refers to an upward/downward direction of the operator who sits at the operator's seat. A direction in which the operator sitting at the operator's seat faces is defined as the fore direction and a direction behind the operator sitting at the operator's seat is defined as the aft direction. A right side and a left side at the time when the operator sitting at the operator's seat faces front are defined as the right direction and the left direction, respectively. A foot side of the operator who sits at the operator's seat is defined as a lower side, and a head side is defined as an upper side.

Vehicular body frame 2 includes a rear frame 21, a front frame 22, and an exterior cover 25. Rear frame 21 supports exterior cover 25 and components such as the engine arranged in engine compartment 6. Exterior cover 25 covers engine compartment 6. Exterior cover 25 is provided with an upper opening 26, a lateral opening 27, and a rear opening. Upper opening 26, lateral opening 27, and the rear opening are provided to pass through exterior cover 25 in a direction of thickness.

Rear frame 21 supports exterior cover 25 and components such as the engine arranged in engine compartment 6. Exterior cover 25 covers engine compartment 6. For example, each of four rear wheels 12 is attached to rear frame 21 as being rotatably driven by driving force from the engine.

Front frame 22 is attached in front of rear frame 21. Front frame 22 is pivotably coupled to rear frame 21. Front frame 22 extends in the fore/aft direction. Front frame 22 includes a base end portion coupled to rear frame 21 and a tip end portion opposite to the base end portion. Front frame 22 includes a front end. The front end is included in the tip end portion of front frame 22. For example, two front wheels 11 are rotatably attached to the tip end portion of front frame 22.

A counter weight 51 is attached to the front end of front frame 22 (or a front end of vehicular body frame 2). Counter weight 51 represents one type of attachments to be attached to front frame 22. Counter weight 51 is attached to front frame 22 in order to increase a downward load to be applied to front wheel 11 to allow steering and to increase a pressing load on blade 42.

Cab 3 is carried on front frame 22. In cab 3, an operation portion (not shown) such as a steering wheel, a gear shift lever, a lever for controlling work implement 4, a brake, an accelerator pedal, and an inching pedal is provided. Cab 3 may be carried on rear frame 21.

Work implement 4 mainly includes a draw bar 40, a swing circle 41, blade 42, a hydraulic motor 49, and various hydraulic cylinders 44 to 48.

Draw bar 40 has a front end portion swingably attached to the tip end portion of front frame 22. Draw bar 40 has a rear end portion supported on front frame 22 by a pair of lift cylinders 44 and 45. As a result of extending and retracting of the pair of lift cylinders 44 and 45, the rear end portion of draw bar 40 can move up and down with respect to front frame 22. Therefore, as lift cylinders 44 and 45 both retract, a height of blade 42 with respect to front frame 22 is adjusted in the upward direction. As lift cylinders 44 and 45 both extend, a height of blade 42 with respect to front frame 22 is adjusted in the downward direction.

Draw bar 40 is vertically swingable with an axis along a direction of travel of the vehicle being defined as the center, as a result of extending and retracting of lift cylinders 44 and 45.

A draw bar shift cylinder 46 is attached to front frame 22 and a side end portion of draw bar 40. As a result of extending and retracting of draw bar shift cylinder 46, draw bar 40 is movable laterally with respect to front frame 22.

Swing circle 41 is revolvably (rotatably) attached to the rear end portion of draw bar 40. Swing circle 41 can be driven by hydraulic motor 49 as being revolvable clockwise or counterclockwise with respect to draw bar 40 when viewed from above the vehicle. As swing circle 41 is driven to revolve, a blade angle of blade 42 is adjusted.

Blade 42 is arranged between front wheel 11 and rear wheel 12. Blade 42 is arranged between the front end of vehicular body frame 2 (or the front end of front frame 22) and a rear end of vehicular body frame 2. Blade 42 is supported on swing circle 41. Blade 42 is supported on front frame 22 with swing circle 41 and draw bar 40 being interposed.

Blade 42 is supported as being movable in the lateral direction with respect to swing circle 41. Specifically, a blade shift cylinder 47 is attached to swing circle 41 and blade 42 and arranged along a longitudinal direction of blade 42. With blade shift cylinder 47, blade 42 is movable in the lateral direction with respect to swing circle 41. Blade 42 is movable in a direction intersecting with a longitudinal direction of front frame 22.

Blade 42 is supported as being swingable around an axis extending in the longitudinal direction of blade 42 with respect to swing circle 41. Specifically, a tilt cylinder 48 is attached to swing circle 41 and blade 42. As a result of extending and retracting of tilt cylinder 48, blade 42 swings around the axis extending in the longitudinal direction of blade 42 with respect to swing circle 41, so that an angle of inclination of blade 42 with respect to the direction of travel of the vehicle can be changed.

A position detection sensor 64 is arranged on an upper ceiling of cab 3. Position detection sensor 64 includes an antenna for real time kinematic-global navigation satellite systems (RTK-GNSS) and a global coordinate computer.

An inertial measurement unit (IMU) 66 is arranged on the upper ceiling of cab 3. IMU 66 detects an inclination of vehicular body frame 2. In the embodiment, IMU 66 detects an angle of inclination θ2 with respect to the lateral direction of vehicular body frame 2 (see FIG. 7 (B)) and an angle of inclination θ1 with respect to the fore/aft direction of vehicular body frame 2 (see FIG. 7 (A)). IMU 66 updates angle of inclination θ1 and angle of inclination θ2, for example, in a period of 100 Hz.

<B. Mechanism>

Figure 3:
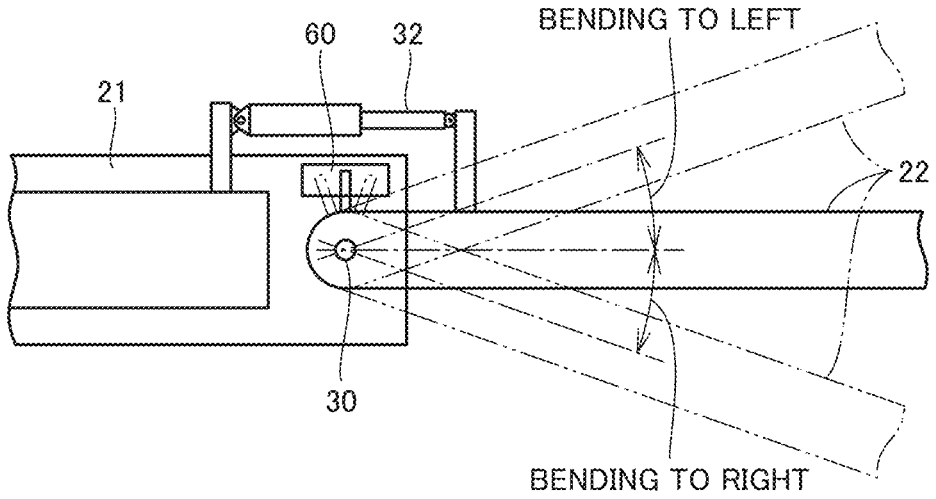
FIG. 3 is a diagram illustrating overview of a construction of a pivot mechanism of motor grader 1 based on the embodiment.

FIG. 3 is a diagram illustrating overview of a construction of a pivot mechanism of motor grader 1 based on the embodiment.

As shown in FIG. 3, front frame 22 and rear frame 21 are coupled to each other with a vertical central pin 30. Specifically, front frame 22 is pivotably coupled to rear frame 21 at a position substantially below cab 3. Front frame 22 pivots with respect to rear frame 21 as a result of extending and retracting of an articulation cylinder 32 coupled between front frame 22 and rear frame 21 based on an operation of a control lever in cab 3. By bending (articulating) front frame 22 with respect to rear frame 21, a slewing radius at the time of revolution of motor grader 1 can be smaller and works for excavating a groove and cutting a slope by offset running can be done. Offset running refers to linear travel of motor grader 1 by setting a direction of bending of front frame 22 with respect to rear frame 21 and a direction of revolution of front wheel 11 with respect to the front frame to directions opposite to each other. An articulation angle detection sensor 60 is attached to rear frame 21, and the articulation angle detection sensor detects an angle of articulation representing an angle of bending of front frame 22 with respect to rear frame 21. When front frame 22 is located at a neutral position with respect to rear frame 21, an angle of articulation is defined as 0°.

Figure 4:
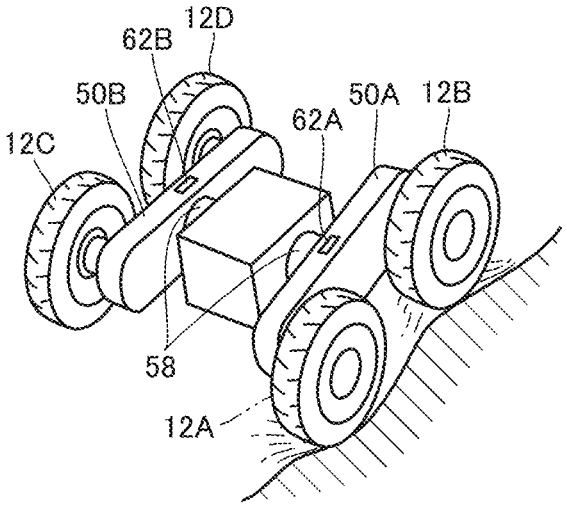
FIG. 4 is a diagram illustrating overview of a construction of a swing mechanism of motor grader 1 based on the embodiment.

FIG. 4 is a diagram illustrating overview of a construction of a swing mechanism of motor grader 1 based on the embodiment.

FIG. 4 shows two rear wheels 12A and 12B on the left side and two rear wheels 12C and 12D on the right side with respect to vehicular body frame 2. Rear wheels 12A and 12B are arranged in front and rear relation. Rear wheels 12C and 12D are arranged in front and rear relation.

Tandem apparatus 50A rotatably supporting both of rear wheels 12A and 12B and swingably supporting both of rear wheels 12A and 12B with respect to vehicular body frame 2 and a tandem apparatus 50B rotatably supporting both of rear wheels 12C and 12D and swingably supporting both of rear wheels 12C and 12D with respect to vehicular body frame 2 are provided.

An engine is coupled to a rear axle 58 with driving force transmission means (not shown) being interposed.

Tandem apparatuses 50A and SOB are swing members and provided as being swingable around rear axle 58.

Though not shown, rear axle 58 and shafts of rear wheels 12B and 12D are connected to each other with the driving force transmission means being interposed. By driving the engine, motor grader 1 travels with rear wheels 12B and 12D functioning as driving wheels whereas rear wheels 12A and 12C functioning as driven wheels.

In the present example, rear wheels 12 swing with tandem apparatuses 50A and SOB being interposed in accordance with projections and recesses in current topography on which the motor grader travels. By providing tandem apparatuses 50A and 50B, transmission of sway due to projections and recesses to blade 42 through vehicular body frame 2 is prevented as much as possible. Motor grader 1 can thus do highly accurate land-grading works.

Tandem angle detection sensors 62A and 62B which detect a tandem angle of swing of rear wheels 12 with tandem apparatuses 50A and 50B being interposed are attached to tandem apparatuses 50A and 50B, respectively.

<C. System Configuration>

Figure 5:
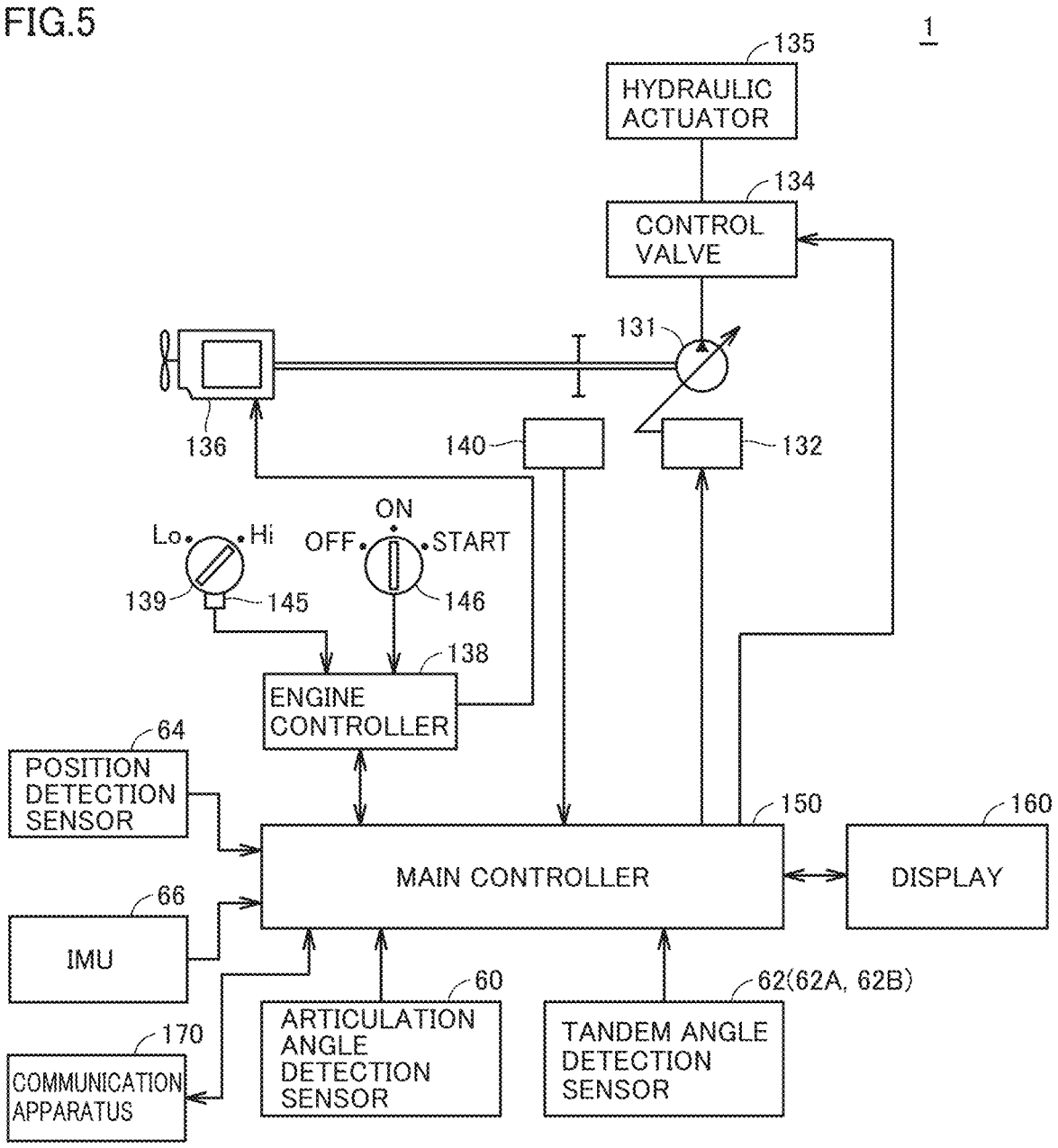
FIG. 5 is a block diagram showing a configuration of a control system included in motor grader 1 based on the embodiment.

FIG. 5 is a block diagram showing a configuration of a control system included in motor grader 1 based on the embodiment.

As shown in FIG. 5, the control system of motor grader 1 includes, by way of example, a hydraulic pump 131, a control valve 134, a hydraulic actuator 135, an engine 136, an engine controller 138, a throttle dial 139, a rotation sensor 140, a potentiometer 145, a starter switch 146, a main controller 150, articulation angle detection sensor 60, tandem angle detection sensor 62, position detection sensor 64, IMU 66, a display 160, and a communication apparatus 170.

Hydraulic pump 131 delivers hydraulic oil used for driving work implement 4 and the like.

Hydraulic actuator 135 is connected to hydraulic pump 131 with control valve 134 being interposed. Hydraulic actuator 135 includes an articulation cylinder 32.

A swash plate drive apparatus 132 is driven based on an instruction from main controller 150 and changes an angle of inclination of a swash plate of hydraulic pump 131.

Control valve 134 controls hydraulic actuator 135. Control valve 134 is implemented by a proportional solenoid valve and connected to main controller 150. Main controller 150 outputs an operation signal (electric signal) in accordance with a direction of operation and/or an amount of operation of a work implement lever and a travel control lever to control valve 134. Control valve 134 controls an amount of hydraulic oil to be supplied from hydraulic pump 131 to hydraulic actuator 135 in accordance with the operation signal.

Engine 136 has a driveshaft connected to hydraulic pump 131 and hydraulic pump 131 is driven in coordination with the driveshaft.

Engine controller 138 controls an operation of engine 136 in accordance with an instruction from main controller 150. Engine 136 is implemented by a diesel engine by way of example. The number of rotations of engine 136 is set through throttle dial 139 or the like, and an actual number of rotations of the engine is detected by rotation sensor 140. Rotation sensor 140 is connected to main controller 150.

Potentiometer 145 is provided in throttle dial 139. Potentiometer 145 detects a set value (an amount of operation) of throttle dial 139. The set value of throttle dial 139 is transmitted to main controller 150. Potentiometer 145 outputs a command value for the number of rotations of engine 136 to engine controller 138. A target number of rotations of engine 136 is adjusted in accordance with the command value.

Engine controller 138 adjusts the number of rotations of engine 136 by controlling an amount of fuel injection by a fuel injection apparatus in accordance with an instruction from main controller 150.

Starter switch 146 is connected to engine controller 138. When an operator operates starter switch 146 (sets start), a start signal is output to engine controller 138 so that engine 136 starts.

Main controller 150 is a controller which controls the entire motor grader 1 and implemented by a central processing unit (CPU), a non-volatile memory, a timer, and the like.

Though a configuration in which main controller 150 and engine controller 138 are separate from each other is described in the present example, they can also be implemented as one common controller.

Main controller 150 is connected to articulation angle detection sensor 60, tandem angle detection sensor 62, position detection sensor 64, IMU 66, and communication apparatus 170. Main controller 150 obtains sensor information and calculates positions of the rear wheels based on the obtained sensor information. Main controller 150 obtains current topography data based on the calculated positions of the rear wheels and has display 160 show work support information based on comparison with design topography data.

Communication apparatus 170 is provided to transmit and receive data through a communication network to and from an external apparatus (for example, a server). For example, information on the calculated positions of the rear wheels may be transmitted to an external apparatus by using communication apparatus 170. Work support information shown on display 160 may be transmitted to an external apparatus.

<D. Control Flow>

Figure 6:
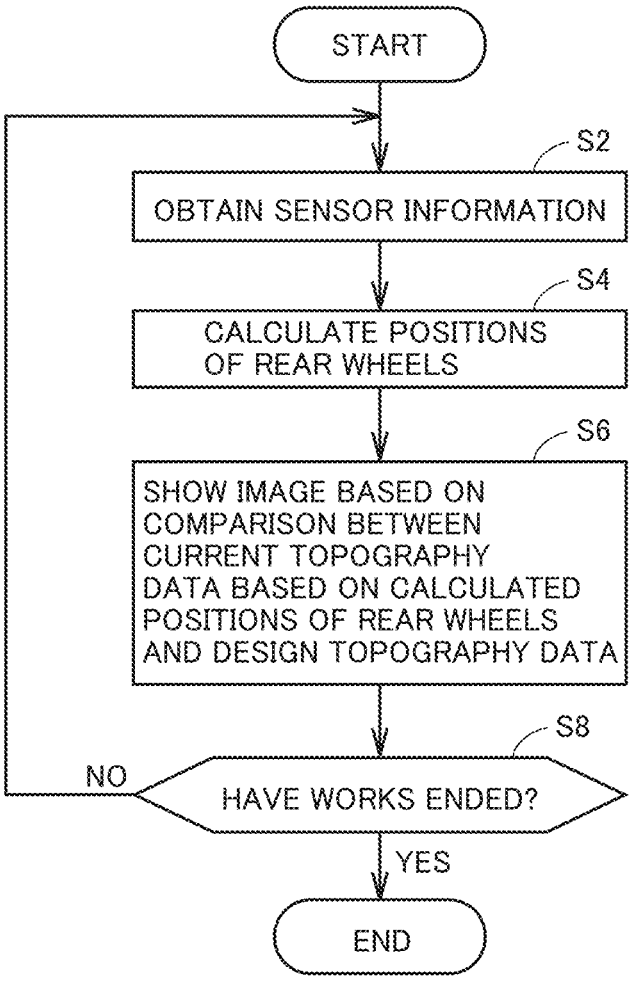
FIG. 6 is a flowchart illustrating a scheme for motor grader 1 based on the embodiment to obtain current topography.

FIG. 6 is a flowchart illustrating a scheme for motor grader 1 based on the embodiment to obtain current topography.

Referring to FIG. 6, main controller 150 obtains sensor information (step S2). Main controller 150 obtains sensor information detected by each of articulation angle detection sensor 60, tandem angle detection sensor 62, position detection sensor 64, and IMU 66.

Then, main controller 150 calculates positions of the rear wheels of motor grader 1 (step S4). Main controller 150 calculates positions of the rear wheels based on sensor information detected by each of articulation angle detection sensor 60, tandem angle detection sensor 62, position detection sensor 64, and IMU 66.

Figure 7:
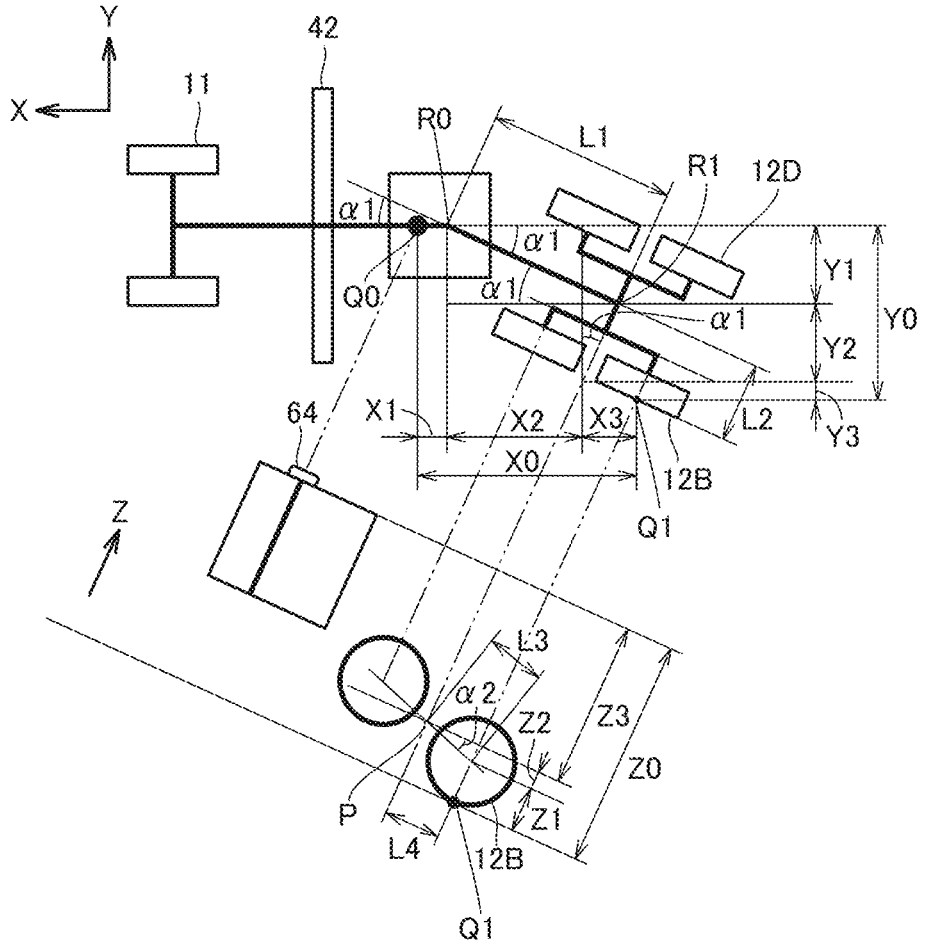
FIG. 7 is a diagram illustrating a scheme for calculating positions of rear wheels of motor grader 1 based on the embodiment.
Figure 7:
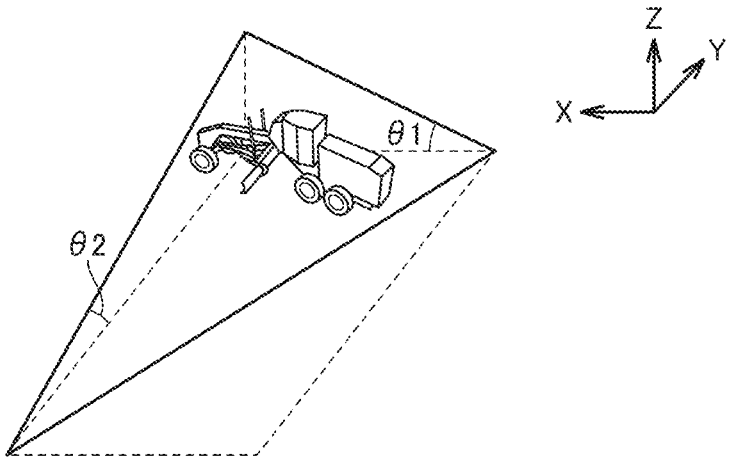

FIG. 7 is a diagram illustrating a scheme for calculating positions of the rear wheels of motor grader 1 based on the embodiment.

FIG. 7 (A) shows a diagram showing motor grader 1 like a model when motor grader 1 is viewed from above.

In the present example, a scheme for calculating positions of the rear wheels based on various types of sensor information will be described. Specifically, a position where rear wheel 12B on the left side is in contact with current topography is calculated.

By way of example, a direction of straight travel of motor grader 1 is defined as an X direction and a direction orthogonal to the X direction is defined as a Y direction.

Cab 3 is provided on front frame 22 and a position Q0 of position detection sensor 64 provided on the upper ceiling of cab 3 can be obtained based on sensor information from position detection sensor 64.

A position Q1 of a rear wheel is calculated with position Q0 being defined as the reference coordinate.

A coordinate X0 in the X direction of position Q1 of the rear wheel with position Q0 being defined as the reference coordinate is expressed in the following formula:

$$\text{coordinate } X0=X1+X2+X3$$

where X1 represents a length between position Q0 and a position of bending R0 and it has an already known value set in advance.

X2 is expressed in the following formula:

$$X2=L1\times\cos(\alpha1)-L2\times\sin(\alpha1)$$

where L1 represents a length between position of bending R0 and a position of the center R1 of rear axle 58 and has an already known value set in advance. An angle α1 represents an angle of articulation and detected by articulation angle detection sensor 60.

X3 is expressed in the following formula:

$$X3=L4\times\cos(\alpha1)$$

$$L4=L3\times\cos(\alpha2)$$

$$X3=L3\times\cos(\alpha2)\times\cos(\alpha1)$$

where L3 represents a length between a central point of rear wheel 12B and central point of swing P and has an already known value set in advance. An angle α2 represents a tandem angle and detected by tandem angle detection sensor 62.

Coordinate X0 in the X direction of position Q1 of the rear wheel is expressed in the following formula based on the results of calculation above.

$$\text{coordinate } X0=X1+L1\times\cos(\alpha1)-L2\times\sin(\alpha1)+L3\times\cos(\alpha2)\times\cos(\alpha1)$$

Then, a coordinate Y0 in the Y direction of position Q1 of the rear wheel with position Q0 being defined as the reference coordinate is expressed in the following formula.

$$\text{Coordinate } Y0=Y1+Y2+Y3$$

Y1 is expressed in the following formula.

$$Y1=L1\times\sin(\alpha1)$$

Y2 is expressed in the following formula:

$$Y2=L2\times\cos(\alpha1)$$

where L2 represents a length between the centerline of rear frame 21 and rear wheel 12B and has an already known value set in advance.

$$Y3=L4\times\sin(\alpha1)$$

$$L4=L3\alpha\cos(\alpha2)$$

$$Y3=L3\times\cos(\alpha2)\times\sin(\alpha1)$$

Coordinate Y0 in the Y direction of position Q1 of the rear wheel is expressed in the following formula based on the results of calculation above.

$$\text{Coordinate } Y0=L1\times\sin(\alpha1)+L2\times\cos(\alpha1)+L3\times\cos(\alpha2)\times\sin(\alpha1)$$

Then, a coordinate Z0 in a Z direction of position Q1 of rear wheel 12B with position Q0 being defined as the reference coordinate is expressed in the following formula:

$$\text{coordinate } Z0=Z1+Z2+Z3$$

where Z1 represents a length of a radius of rear wheel 12 and Z3 represents a length between central point of swing P in the Z direction and position detection sensor 64. Z1 and Z3 have already known values set in advance.

$$Z2=L3\times\sin(\alpha2)$$

Coordinate Z0 in the Z direction of position Q1 of the rear wheel is expressed in the following formula based on the results of calculation above.

$$\text{Coordinate } Z0=Z1+L3\times\sin(\alpha2)+Z3$$

Coordinate X0, Y0, Z0 resulting from calculation above represents a coordinate (a vehicular body absolute coordinate) when motor grader 1 is graded to a horizontal plane (when vehicular body frame 2 is not inclined).

FIG. 7 (B) illustrates correction of coordinate X0, Y0, Z0 of position Q1 of the rear wheel in consideration of inclination of the vehicular body.

As shown in the figure, motor grader 1 is inclined along current topography in the fore/aft direction and the lateral direction. In the present example, an azimuth of vehicular body frame 2 (front frame 22 where position detection sensor 64 and IMU 66 are arranged) is obtained based on a position velocity vector (GNSS velocity vector) based on position data from position detection sensor 64. IMU 66 detects angle of inclination θ2 with respect to the lateral direction of vehicular body frame 2 and angle of inclination θ1 with respect to the fore/aft direction of vehicular body frame 2.

A coordinate (X, Y, Z) of position Q1 of the rear wheel in consideration of the inclination is calculated in the following formula.

$$X=X0\times\cos(\theta1)=(X1+L1\times\cos(\alpha1)-L2\times\sin(\alpha1)+L3\times\cos(\alpha2)\times\cos(\alpha1))\times\cos(\theta1)$$

$$Y=Y0\times\cos(\theta2)=(L1\times\sin(\alpha1)+L2\times\cos(\alpha1)+L3\times\cos(\alpha2)\times\sin(\alpha1))\times\cos(\theta2)$$

$$Z=Z0/\text{sqrt}(\tan2(\theta1)+\tan2(\theta2)+1)=(Z1+L3\times\sin(\alpha2)+Z3)/\text{sqrt}(\tan2(\theta1)+\tan2(\theta2)+1)$$

Coordinate X, Y, Z resulting from calculation above is a global coordinate of the position of the rear wheel of motor grader 1 in consideration of an inclination of the vehicular body of motor grader 1 with position Q0 being defined as the reference coordinate.

Current topography data can thus be obtained in accordance with the calculated position of the rear wheel of motor grader 1. Main controller 150 obtains position Q1 of the rear wheel in the global coordinate system based on data on the vehicular body absolute coordinate, the position velocity vector, and the inclination of the vehicular body. Main controller 150 converts the vehicular body absolute coordinate (a local position) of the rear wheel into the global coordinate (a global position).

Referring again to FIG. 6, main controller 150 has an image shown based on comparison between current topography data based on the calculated position of the rear wheel and design topography data (step S6).

Main controller 150 compares the design topography data stored in advance in a non-volatile memory or the like with the calculated current topography data, and has an image based on the difference shown. For example, an image based on a difference in height at the same point between the current topography data and the design topography data is shown.

Figure 8:
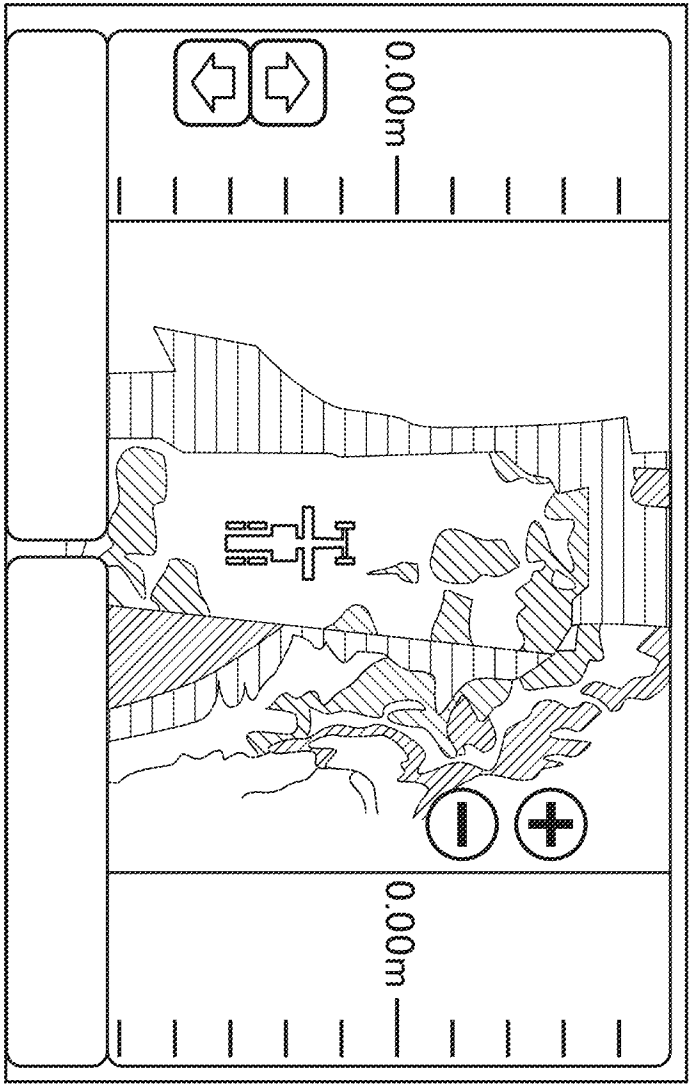
FIG. 8 is a diagram illustrating an image shown on a display 160 of motor grader 1 based on the embodiment.

FIG. 8 is a diagram illustrating an image shown on display 160 of motor grader 1 based on the embodiment.

As shown in FIG. 8, together with motor grader 1, an image based on a difference in height from design topography data is shown as information on current topography around the motor grader, which serves as work support information.

By way of example, various hatched regions are shown and the hatched regions are different in type in accordance with a difference in height at the same point between the design topography data and the current topography data. For example, the type may be varied between an example in which a difference in height is great and an example in which a difference in height is small. By showing such an image, an operator can readily recognize a difference between the current topography data and the design topography data, and efficiency in land-grading works can be improved.

Referring again to FIG. 6, main controller 150 determines whether or not works have ended (step S8). When it is determined that the works have ended (YES in step S8), the process ends (end). When it is determined in step S8 that the works have not ended (NO in step S8), the process returns to step S2. Then, the process is repeated.

Based on the scheme, current topography to be worked can accurately and efficiently be measured based on a position of the rear wheel of motor grader 1. Then, execution works high in execution accuracy can be done by showing an image based on the design topography data representing a target shape of an object to be worked and the current topography data.

In particular, in the present example, current topography data is obtained based on a position of rear wheel 12 located in the rear of blade 42. Therefore, current topography after land-grading works with blade 42 can accurately be known. Since the present scheme calculates a position of rear wheel 12 which swings owing to tandem apparatus 50 based on sensor information from tandem angle detection sensor 62, projections and recesses in current topography can accurately be measured and accuracy in execution can be improved.

<E. Modification>

<e1. First Modification>

An example in which a position of rear wheel 12B of motor grader 1 is calculated is described above. Current topography data may be obtained by calculating a position of rear wheel 12A.

Furthermore, current topography data may be obtained by calculating positions of rear wheels 12A and 12B.

In the present example, a scheme for calculating a position of rear wheel 12B on the left based on sensor information from tandem angle detection sensor 62A attached to tandem apparatus 50A is described.

A position of at least any one of rear wheels 12C and 12D on the right side can also be calculated. Specifically, a position of rear wheel 12D on the right side can also be calculated with the scheme the same as above, based on sensor information from tandem angle detection sensor 62B attached to tandem apparatus 50B.

Main controller 150 obtains sensor information from articulation angle detection sensor 60, tandem angle detection sensor 62A, position detection sensor 64, and IMU 66 and calculates a position of rear wheel 12B based on the scheme the same as described above based on the obtained sensor information, and obtains sensor information from articulation angle detection sensor 60, tandem angle detection sensor 62B, position detection sensor 64, and IMU 66 and calculates a position of rear wheel 12D based on the scheme the same as described above based on the obtained sensor information.

By calculating positions of rear wheels 12B and 12D on the right side and the left side, current topography data at two points can simultaneously be obtained so that current topography data over a wide range can be obtained. The number of times of travel can thus be decreased and execution works can efficiently be done.

<e2. Second Modification>

Though a construction in which cab 3 is attached to front frame 22 and position detection sensor 64 is attached to the upper ceiling of cab 3 is described above, a construction in which cab 3 is attached to rear frame 21 and position detection sensor 64 is attached to the upper ceiling of cab 3 is also possible.

When cab 3 is attached to rear frame 21, relative positional relation between position detection sensor 64 of cab 3 provided in rear frame 21 and rear wheel 12B is not varied in spite of bending of front frame 22 with respect to rear frame 21.

Therefore, main controller 150 can obtain sensor information from tandem angle detection sensor 62, position detection sensor 64, and IMU 66, and calculate a position of rear wheel 12B based on the scheme the same as described above based on the obtained sensor information. Therefore, projections and recesses in current topography after land-grading works can accurately be measured with a simplified configuration.

Though motor grader 1 includes cab 3 in the embodiment described so far, motor grader 1 does not necessarily have to include cab 3. Motor grader 1 is not limited to such specifications that an operator is on board motor grader 1 to operate motor grader 1, but the specifications may be such that the motor grader is operated under external remote control. Since motor grader 1 does not require cab 3 for an operator to get on board in this case, motor grader 1 does not have to include cab 3. When cab 3 is not provided, position detection sensor 64 and IMU 66 may be arranged on rear frame 21 or front frame 22.

<e3. Third Modification>

Though an example in which a position of rear wheel 12B of motor grader 1 is calculated is described above, a result of calculation may be managed by an external apparatus.

Figure 9:
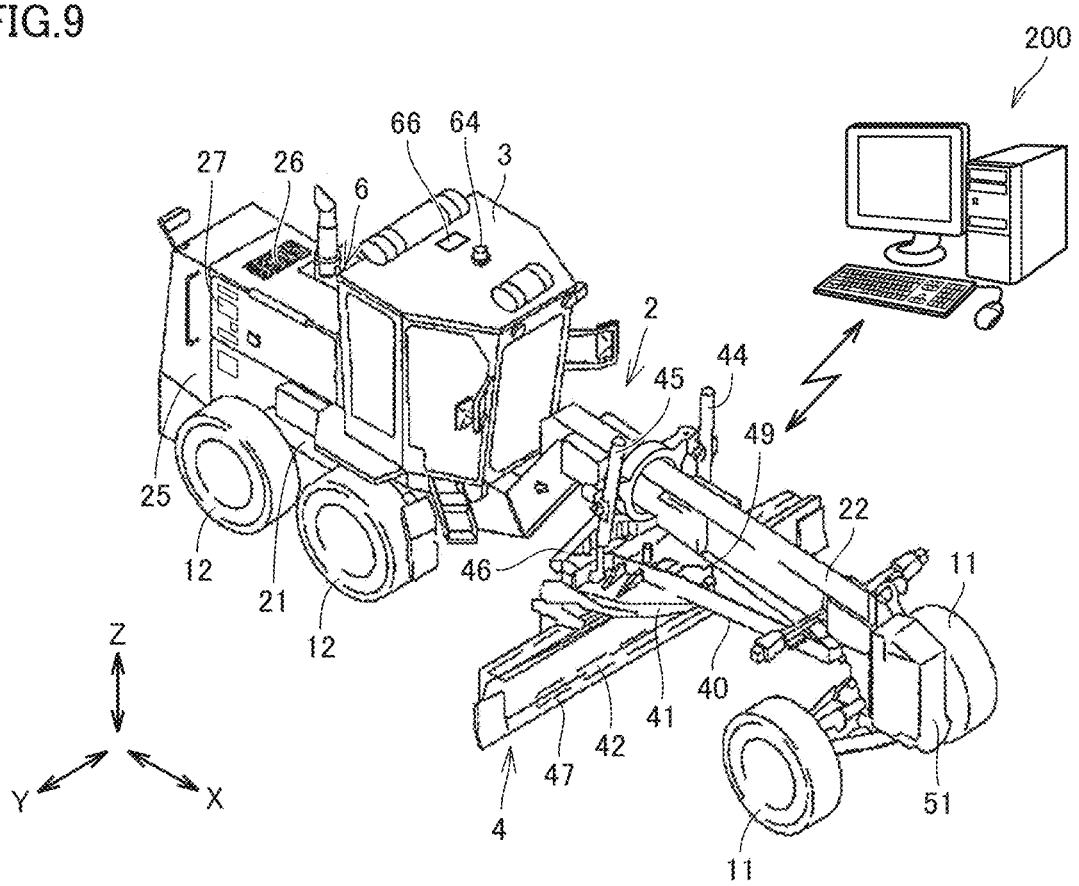
FIG. 9 is a conceptual diagram of a work management system based on a third modification of the embodiment.

FIG. 9 is a conceptual diagram of a work management system based on a third modification of the embodiment.

Referring to FIG. 9, the motor grader and an external apparatus 200 (for example, a server) are provided to communicate with each other.

A state of motor grader 1 can be known from a remote location by transmitting information on motor grader 1 to external apparatus 200.

By transmitting information on a position of rear wheel 12B of motor grader 1 described above to external apparatus 200 with a display, external apparatus 200 at a remote location can accurately know current topography to be worked.

Figure 10:
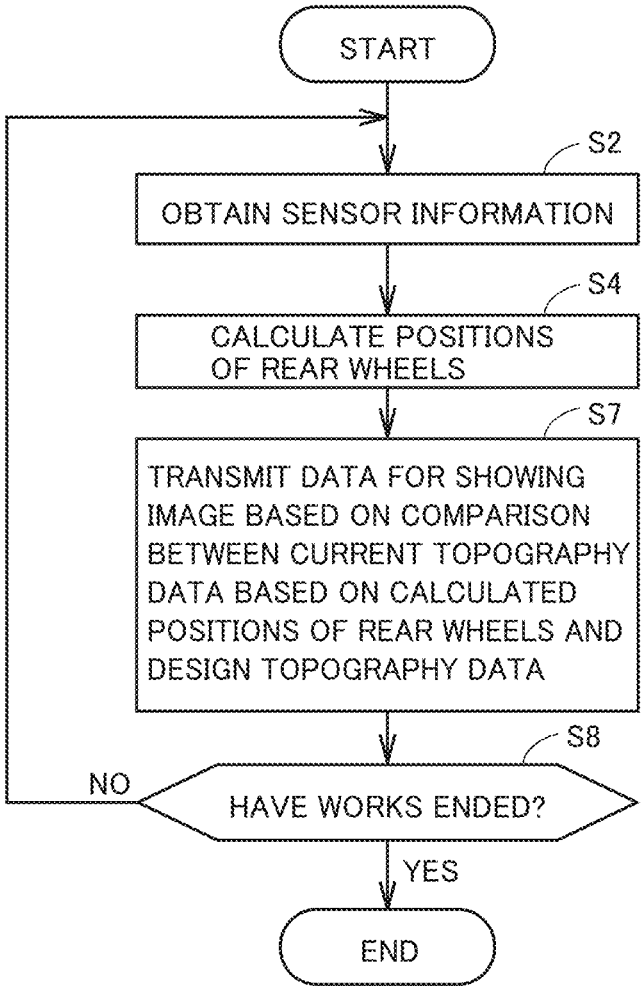
FIG. 10 is a flowchart illustrating a scheme for motor grader 1 based on the third modification of the embodiment to obtain current topography.

FIG. 10 is a flowchart illustrating a scheme for motor grader 1 based on the third modification of the embodiment to obtain current topography.

FIG. 10 is different from the flowchart in FIG. 6 in that step S6 is replaced with step S7.

Specifically, in step S7, main controller 150 transmits data for showing an image based on comparison between current topography data based on the calculated position of the rear wheel and design topography data. Communication apparatus 170 transmits the data to external apparatus 200.

Since the configuration is otherwise the same as described with reference to FIG. 6, detailed description will not be repeated.

According to the configuration, external apparatus 200 can obtain data for showing an image based on comparison between current topography data based on the calculated position of the rear wheel and the design topography data and show an image the same as described with reference to FIG. 8 on the display.

Current topography to be worked can thus accurately be known by using a display of external apparatus 200 provided at a remote location.

<Function and Effect>

A motor grader according to one disclosure includes a vehicular body, a blade attached to the vehicular body, a front wheel located in front of the blade and attached on each of a left side and a right side of the vehicular body, two rear wheels located in the rear of the blade and arranged in front and rear relation on each of the left side and the right side of the vehicular body, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, and a third sensor which detects an angle of swing of the first swing member with respect to the vehicular body as third sensor information. A method of controlling a motor grader includes obtaining the first to third sensor information detected by the first to third sensors and calculating positions of the rear wheels based on the obtained first to third sensor information.

Therefore, an angle of swing of the first swing member with respect to the vehicular body can be detected as third sensor information and positions of the rear wheels can be calculated by using the third sensor information. Projections and recesses in current topography after land-grading works can thus accurately be measured.

Preferably, the first swing member is provided for the two rear wheels provided on one of the left side and the right side of the vehicular body. The motor grader further includes a second swing member which is provided for the two rear wheels provided on the other of the left side and the right side of the vehicular body, rotatably supports both of the two rear wheels arranged in the front and rear relation, and is swingably supported by the vehicular body and a fourth sensor which detects an angle of swing of the second swing member with respect to the vehicular body as fourth sensor information. In the calculating positions of the rear wheels, positions of the rear wheels provided on one of the left side and the right side of the vehicular body are calculated based on the obtained first to third sensor information, and positions of the rear wheels provided on the other of the left side and the right side of the vehicular body are calculated based on the obtained first, second, and fourth sensor information.

Therefore, positions of the rear wheels provided on one of the left side and the right side of the vehicular body are calculated based on the first to third sensor information, and positions of the rear wheels provided on the other of the left side and the right side of the vehicular body are calculated based on the first, second, and fourth sensor information. Therefore, projections and recesses in current topography at two points can simultaneously and accurately be measured.

Preferably, the vehicular body includes a front frame to which the front wheel is attached and a rear frame pivotably coupled to the front frame, the rear wheels being attached to the rear frame. The first sensor is attached to the front frame. The motor grader further includes an angle sensor which detects an angle of pivot of the front frame with respect to the rear frame. In the calculating positions of the rear wheels, positions of the rear wheels are calculated based on the obtained sensor information and the angle of pivot.

Therefore, an angle of pivot of the front frame with respect to the rear frame is detected and positions of the rear wheels are calculated by using the angle of pivot. Therefore, a motor grader constructed such that the first sensor is attached to the front frame can accurately measure projections and recesses in current topography after land-grading works.

Preferably, showing an image based on comparison between the positions of the rear wheels and design topography is further included.

Therefore, by showing an image based on comparison between the current topography based on the positions of the rear wheels and the design topography, a difference therebetween can readily be checked and efficiency in land-grading works can be improved.

Preferably, transmitting data for showing an image based on comparison between the positions of the rear wheels and design topography to the outside is further included.

Therefore, an image based on comparison between the current topography based on the positions of the rear wheels and the design topography is shown on an external apparatus, so that a difference therebetween can readily be checked and current topography can readily be known.

A motor grader according to one disclosure includes a vehicular body, a blade attached to the vehicular body, a front wheel located in front of the blade and attached on each of a left side and a right side of the vehicular body, two rear wheels located in the rear of the blade and arranged in front and rear relation on each of the left side and the right side of the vehicular body, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, a third sensor which detects an angle of swing of the first swing member with respect to the vehicular body as third sensor information, and a controller connected to the first to third sensors. The controller obtains the first to third sensor information detected by the first to third sensors and calculates positions of the rear wheels based on the obtained first to third sensor information.

Therefore, an angle of swing of the first swing member with respect to the vehicular body can be detected as third sensor information and positions of the rear wheels are calculated by using the third sensor information. Projections and recesses in the current topography after land-grading works can thus accurately be measured.

Preferably, the vehicular body includes a front frame to which the front wheel is attached and a rear frame pivotably coupled to the front frame, the rear wheels being attached to the rear frame. The first sensor is attached to the rear frame.

Therefore, according to the construction of the motor grader in which the first sensor is attached to the rear frame, positions of the rear wheels are calculated without using an angle of pivot of the front frame with respect to the rear frame. Therefore, projections and recesses in current topography after land-grading works can accurately be measured with a simplified configuration.

Preferably, the first swing member is provided for the two rear wheels provided on one of the left side and the right side of the vehicular body. A second swing member which is provided for the two rear wheels provided on the other of the left side and the right side of the vehicular body, rotatably supports both of the two rear wheels arranged in the front and rear relation, and is swingably supported by the vehicular body and a fourth sensor which detects an angle of swing of the second swing member with respect to the vehicular body as fourth sensor information are further provided. The controller further obtains the fourth sensor information detected by the fourth sensor, calculates positions of the rear wheels provided on one of the left side and the right side of the vehicular body based on the obtained first to third sensor information, and calculates positions of the rear wheels provided on the other of the left side and the right side of the vehicular body based on the obtained first, second, and fourth sensor information.

Therefore, positions of the rear wheels provided on one of the left side and the right side of the vehicular body are calculated based on the first to third sensor information, and positions of the rear wheels provided on the other of the left side and the right side of the vehicular body are calculated based on the first, second, and fourth sensor information. Therefore, projections and recesses in current topography at two points can simultaneously and accurately be measured.

Preferably, the vehicular body includes a front frame to which the front wheel is attached and a rear frame pivotably coupled to the front frame, the rear wheels being attached to the rear frame. The first sensor is attached to the front frame. An angle sensor which detects an angle of pivot of the front frame with respect to the rear frame is further provided. The controller calculates positions of the rear wheels based on the obtained sensor information and the angle of pivot.

Therefore, an angle of pivot of the front frame with respect to the rear frame is calculated and positions of the rear wheels are calculated by using the angle of pivot. Therefore, a motor grader constructed such that the first sensor is attached to the front frame can accurately measure projections and recesses in current topography after land-grading works.

Preferably, a display which shows an image based on comparison between the positions of the rear wheels and design topography is further provided.

Therefore, by showing an image based on comparison between the current topography based on the positions of the rear wheels and the design topography, a difference therebetween can readily be checked and efficiency in land-grading works can be improved.

Preferably, a communication apparatus which transmits data for showing an image based on comparison between the positions of the rear wheels and design topography to the outside is further provided.

Therefore, an image based on comparison between the current topography based on the positions of the rear wheels and the design topography is shown on an external apparatus, so that a difference therebetween can readily be checked and current topography can readily be known.

A work management system for a motor grader according to one disclosure includes the motor grader described above and a display which shows an image based on data transmitted from a communication apparatus.

Therefore, by showing an image based on comparison between current topography based on positions of the rear wheels and design topography on the display provided separately from the motor grader, a difference therebetween can readily be checked and current topography can readily be known.

A motor grader according to one disclosure includes a vehicular body including a front frame and a rear frame pivotably coupled to the front frame, a blade attached to the vehicular body, a front wheel located in front of the blade and attached to the vehicular body, a rear wheel located in the rear of the blade and attached to the vehicular body, a position sensor which is attached to the front frame and detects a position of the front frame, an inclination sensor which is attached to the vehicular body and detects an inclination of the vehicular body, and an angle sensor which detects an angle of pivot of the front frame with respect to the rear frame. A method of controlling a motor grader includes obtaining sensor information detected by the position sensor, the inclination sensor, and the angle sensor and calculating a position of the rear wheel based on the obtained sensor information.

Therefore, a position of the front frame is detected by the position sensor, an inclination of the vehicular body is detected by the inclination sensor, and an angle of pivot is detected by the angle sensor. A position of the rear wheel is calculated based on the sensor information. Therefore, projections and recesses in current topography after land-grading works can accurately be measured.

A motor grader according to one disclosure includes a vehicular body including a front frame and a rear frame pivotably coupled to the front frame, a blade attached to the vehicular body, a front wheel located in front of the blade and attached to the vehicular body, a rear wheel located in the rear of the blade and attached to the vehicular body, a position sensor which is attached to the front frame and detects a position of the front frame, an inclination sensor which is attached to the vehicular body and detects an inclination of the vehicular body, an angle sensor which detects an angle of pivot of the front frame with respect to the rear frame, and a controller connected to the position sensor, the inclination sensor, and the angle sensor. The controller obtains sensor information detected by the position sensor, the inclination sensor, and the angle sensor and calculates a position of the rear wheel based on the obtained sensor information.

Therefore, a position of the front frame is detected by the position sensor, an inclination of the vehicular body is detected by the inclination sensor, and an angle of pivot is detected by the angle sensor. A position of the rear wheel is calculated based on the sensor information. Therefore, projections and recesses in current topography after land-grading works can accurately be measured.

The embodiment disclosed herein is illustrative and not restricted to the above disclosure alone. The scope of the present application is defined by the terms of the claims and is intended to include any modifications within the scope and meaning equivalent to the terms of the claims.

REFERENCE SIGNS LIST

1 motor grader; 2 vehicular body frame; 3 cab; 4 work implement; 11 front wheel; 12 rear wheel; 19 axle shaft; 21 rear frame; 22 front frame; 40 draw bar; 41 swing circle; 42 blade; 44, 45 lift cylinder; 46 draw bar shift cylinder; 47 blade shift cylinder; 48 tilt cylinder; 49 hydraulic motor; 50 tandem apparatus; 51 counter weight; 60 articulation angle detection sensor; 62 tandem angle detection sensor; 64 position detection sensor; 66 IMU; 131 hydraulic pump; 132 swash plate drive apparatus; 135 hydraulic actuator; 136 engine; 138 engine controller; 139 throttle dial; 150 main controller; and 160 display

The invention claimed is:

1. A method of controlling a motor grader, the motor grader including a vehicular body, a blade attached to the vehicular body, a front wheel located in front of the blade and attached on each of a left side and a right side of the vehicular body, two rear wheels located in rear of the blade and arranged in front and rear relation on each of the left side and the right side of the vehicular body, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, a third sensor which detects an angle of swing of the first swing member with respect to the vehicular body as third sensor information, and a controller connected to the first to third sensors, the method comprising:

obtaining, by the controller, the first to third sensor information detected by the first to third sensors; and calculating, by the controller, positions of the rear wheels based on the obtained first to third sensor information, the calculated positions of the rear wheels including a coordinate and an angle of inclination with respect to a fore/aft direction of the vehicular body.

2. The method of controlling a motor grader according to claim 1, wherein the first swing member is provided for the two rear wheels provided on one of the left side and the right side of the vehicular body, the motor grader further includes a second swing member which is provided for the two rear wheels provided on the other of the left side and the right side of the vehicular body, rotatably supports both of the two rear wheels arranged in the front and rear relation, and is swingably supported by the vehicular body, and a fourth sensor which detects an angle of swing of the second swing member with respect to the vehicular body as fourth sensor information, in the calculating positions of the rear wheels, positions of the rear wheels provided on one of the left side and the right side of the vehicular body are calculated based on the obtained first to third sensor information, and positions of the rear wheels provided on the other of the left side and the right side of the vehicular body are calculated based on the obtained first, second, and fourth sensor information.

3. The method of controlling a motor grader according to claim 1, wherein the vehicular body includes a front frame to which the front wheel is attached and a rear frame pivotably coupled to the front frame, the rear wheels being attached to the rear frame, the first sensor is attached to the front frame, the motor grader further includes an angle sensor which detects an angle of pivot of the front frame with respect to the rear frame, and in the calculating positions of the rear wheels, positions of the rear wheels are calculated based on the obtained sensor information and the angle of pivot.

4. The method of controlling a motor grader according to claim 1, the method further comprising showing an image based on comparison between the positions of the rear wheels and design topography.

5. The method of controlling a motor grader according to claim 1, the method further comprising transmitting data for showing an image based on comparison between the positions of the rear wheels and design topography to outside.

6. A motor grader comprising:

a vehicular body;

a blade attached to the vehicular body;

a front wheel located in front of the blade and attached on each of a left side and a right side of the vehicular body;

two rear wheels located in rear of the blade and arranged in front and rear relation on each of the left side and the right side of the vehicular body;

a first sensor which detects a position of the vehicular body as first sensor information;

a second sensor which detects an inclination of the vehicular body as second sensor information;

a first swing member which rotatably supports both of the two rear wheels arranged in the front and rear relation and is swingably supported by the vehicular body;

a third sensor which detects an angle of swing of the first swing member with respect to the vehicular body as third sensor information; and a controller connected to the first to third sensors, the controller obtaining the first to third sensor information detected by the first to third sensors and calculating positions of the rear wheels based on the obtained first to third sensor information, the calculated positions of the rear wheels including a coordinate and an angle of inclination with respect to a fore/aft direction of the vehicular body.

7. The motor grader according to claim 6, wherein the vehicular body includes a front frame to which the front wheel is attached, and a rear frame pivotably coupled to the front frame, the rear wheels being attached to the rear frame, and the first sensor is attached to the rear frame.

8. The motor grader according to claim 6, wherein the first swing member is provided for the two rear wheels provided on one of the left side and the right side of the vehicular body, the motor grader further comprises a second swing member which is provided for the two rear wheels provided on the other of the left side and the right side of the vehicular body, rotatably supports both of the two rear wheels arranged in the front and rear relation, and is swingably supported by the vehicular body, and a fourth sensor which detects an angle of swing of the second swing member with respect to the vehicular body as fourth sensor information, the controller further obtains the fourth sensor information detected by the fourth sensor, calculates positions of the rear wheels provided on one of the left side and the right side of the vehicular body based on the obtained first to third sensor information, and calculates positions of the rear wheels provided on the other of the left side and the right side of the vehicular body based on the obtained first, second, and fourth sensor information.

9. The motor grader according to claim 6, wherein the vehicular body includes front frame to which the front wheel is attached, and a rear frame pivotably coupled to the front frame, the rear wheels being attached to the rear frame, the first sensor is attached to the front frame, the motor grader further comprises an angle sensor which detects an angle of pivot of the front frame with respect to the rear frame, and the controller calculates positions of the rear wheels based on the obtained sensor information and the angle of pivot.

10. The motor grader according to claim 6, the motor grader further comprising a display which shows an image based on comparison between the positions of the rear wheels and design topography.

11. The motor grader according to claim 6, the motor grader further comprising a communication apparatus which transmits data for showing an image based on comparison between the positions of the rear wheels and design topography to outside.

12. A work management system for a motor grader comprising a motor grader, the motor grader including a vehicular body, a blade attached to the vehicular body, a front wheel located in front of the blade and attached on each of a left side and a right side of the vehicular body, two rear wheels located in rear of the blade and arranged in front and rear relation on each of the left side and the right side of the vehicular body, a first sensor which detects a position of the vehicular body as first sensor information, a second sensor which detects an inclination of the vehicular body as second sensor information, a first swing member which rotatably supports both of the two rear wheels arranged in the front and rear relation and is swingably supported by the vehicular body, a third sensor which detects an angle of swing of the first swing member with respect to the vehicular body as third sensor information, and a controller connected to the first to third sensors, the controller obtaining the first to third sensor information detected by the first to third sensors and calculating positions of the rear wheels based on the obtained first to third sensor information, the calculated positions of the rear wheels including a coordinate and an angle of inclination with respect to a fore/aft direction of the vehicular body, the motor grader further including a communication apparatus which transmits data for showing an image based on comparison between the positions of the rear wheels and design topography to outside, and a display which shows an image based on the data transmitted from the communication apparatus.

13. A method of controlling a motor grader, the motor grader including a vehicular body including a front frame and a rear frame pivotably coupled to the front frame, a blade attached to the vehicular body, a front wheel located in front of the blade and attached to the vehicular body, a rear wheel located in rear of the blade and attached to the vehicular body, a first swing member which rotatably supports the rear wheel and is swingably supported by the vehicular body, a position sensor which is attached to the front frame and detects a position of the front frame, an inclination sensor which is attached to the vehicular body and detects an inclination of the vehicular body, an articulation angle sensor which detects an angle of pivot of the front frame with respect to the rear frame, and a tandem angle sensor which detects an angle of swing of the first swing member that includes the rear wheel, and a controller connected to the position sensor, the inclination sensor, the articulation angle sensor, and the tandem angle sensor, the method comprising:

obtaining, by the controller, sensor information detected by the position sensor, the inclination sensor, the articulation angle sensor, and the tandem angle sensor; and calculating, by the controller, a position of the rear wheel based on the obtained sensor information, the calculated positions of the rear wheels including a coordinate and an angle of inclination with respect to a fore/aft direction of the vehicular body.

14. A motor grader comprising:

a vehicular body including a front frame and a rear frame pivotably coupled to the front frame;

a blade attached to the vehicular body;

a front wheel located in front of the blade and attached to the vehicular body;

a rear wheel located in rear of the blade and attached to the vehicular body;

a first swing member which rotatably supports the rear wheel and is swingably supported by the vehicular body;

a position sensor which is attached to the front frame and detects a position of the front frame;

an inclination sensor which is attached to the vehicular body and detects an inclination of the vehicular body;

an articulation angle sensor which detects an angle of pivot of the front frame with respect to the rear frame;

a tandem angle sensor which detects an angle of swing of the first swing member that includes the rear wheel, and a controller connected to the position sensor, the inclination sensor, the articulation angle sensor, and the tandem angle sensor; and a controller connected to the position sensor, the inclination sensor, the articulation angle sensor, and the tandem angle sensor, the controller obtaining sensor information detected by the position sensor, the inclination sensor, the articulation angle sensor, and the tandem angle sensor, and calculating a position of the rear wheel based on the obtained sensor information, the calculated positions of the rear wheels including a coordinate and an angle of inclination with respect to a fore/aft direction of the vehicular body.

* * * * *